US007591610B2

(12) United States Patent
Krichten et al.

(10) Patent No.: US 7,591,610 B2
(45) Date of Patent: Sep. 22, 2009

(54) WATER DRAIN TANK OR CHANNEL MODULE

(75) Inventors: David Krichten, Allentown, PA (US); David Chernuta, Burgettstown, PA (US); Michael Garrett, Reading, PA (US); Michael R. Whittemore, Leesport, PA (US)

(73) Assignee: Brentwood Industries, Inc., Reading, PA (US)

( * ) Notice: Subject to any disclaimer, the term of this patent is extended or adjusted under 35 U.S.C. 154(b) by 32 days.

(21) Appl. No.: 11/671,496

(22) Filed: Feb. 6, 2007

(65) Prior Publication Data

US 2007/0181197 A1 Aug. 9, 2007

Related U.S. Application Data

(60) Provisional application No. 60/771,417, filed on Feb. 8, 2006.

(51) Int. Cl.
*E02B 11/00* (2006.01)

(52) U.S. Cl. ..... 405/50; 405/43; 405/53

(58) Field of Classification Search ..... 405/52, 405/53, 55, 50, 43, 36, 40
See application file for complete search history.

(56) References Cited

U.S. PATENT DOCUMENTS

| | | | | |
|---|---|---|---|---|
| 204,038 | A | 5/1878 | Henning | |
| 4,483,640 | A | 11/1984 | Berger et al. | |
| 4,982,533 | A | 1/1991 | Florence | |
| 4,988,235 | A | 1/1991 | Hurley | |
| 5,030,343 | A | 7/1991 | Urriola | |
| 5,472,297 | A | 12/1995 | Heselden | |
| 5,639,364 | A * | 6/1997 | Houck et al. | 405/50 |
| 5,810,510 | A | 9/1998 | Urriola | |
| 5,848,856 | A | 12/1998 | Bohnhoff | |
| 5,916,104 | A | 6/1999 | Lucenet et al. | |
| 6,095,718 | A | 8/2000 | Bohnhoff | |
| 6,170,216 | B1 | 1/2001 | Rye et al. | |
| 6,368,017 | B2 | 4/2002 | Black | |
| 6,428,870 | B1 * | 8/2002 | Bohnhoff | 52/180 |
| 6,648,549 | B1 | 11/2003 | Urriola | |
| 6,779,946 | B1 | 8/2004 | Urriola et al. | |
| 2004/0091320 | A1 * | 5/2004 | Parker | 405/45 |
| 2005/0100401 | A1 | 5/2005 | Urriola | |

FOREIGN PATENT DOCUMENTS

| | | | |
|---|---|---|---|
| AU | 199897123 | A1 | 7/1999 |

(Continued)

*Primary Examiner*—Frederick L Lagman
(74) *Attorney, Agent, or Firm*—Panitch Schwarze Belisario & Nadel LLP

(57) ABSTRACT

A water drain tank or channel module includes a structure having a top platen and a bottom platen, a plurality of generally vertical support members for supporting at least the top platen, the support members being retained in sockets on at least one of the bottom platen and the top platen, and optional side walls each including a water-permeable lattice member that is adapted to support an impermeable membrane or water-permeable geotextile material that is able of controlling the flow of drain water at least out of the module and restricting sediment from entering the module. An assembly of such modules to form a drain tank, channel or storage reservoir is also disclosed.

22 Claims, 5 Drawing Sheets

FOREIGN PATENT DOCUMENTS

| | | | |
|---|---|---|---|
| DE | 4321 350 | A1 | 1/1995 |
| DE | 102004019395 | A1 | 11/2005 |
| EP | 0768432 | A1 | 4/1997 |
| EP | 0787865 | A1 | 8/1997 |
| EP | 1416099 | A2 | 5/2004 |
| EP | 1743984 | A1 | 1/2007 |
| EP | 0952257 | A2 | 8/2007 |
| FR | 2410496 | | 6/1979 |
| GB | 2417733 | | 3/2006 |

* cited by examiner

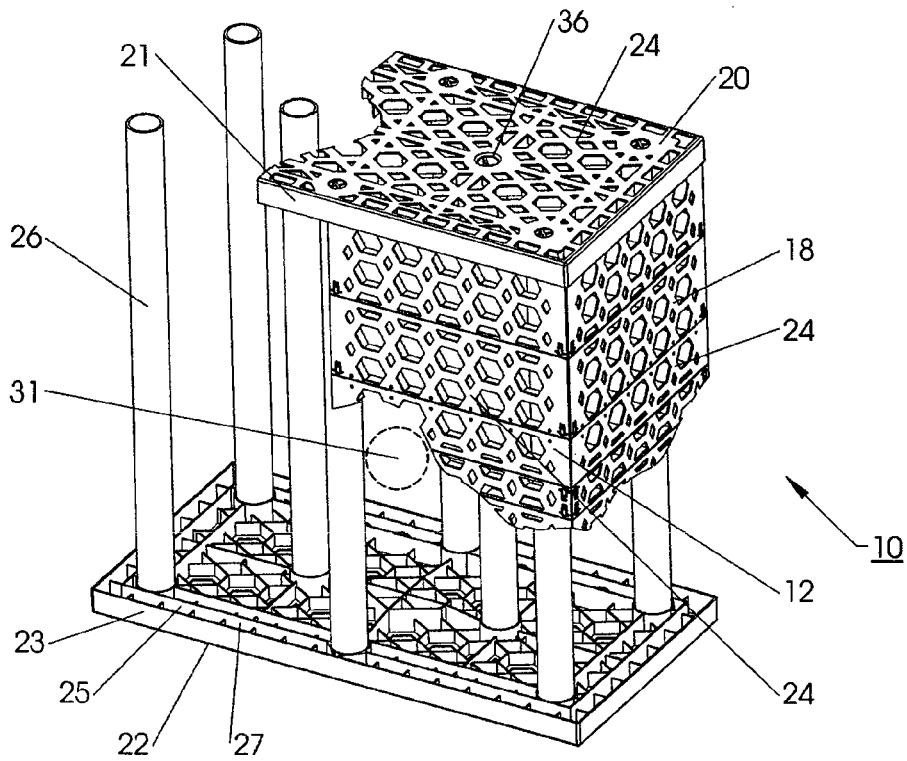
FIGURE 3A
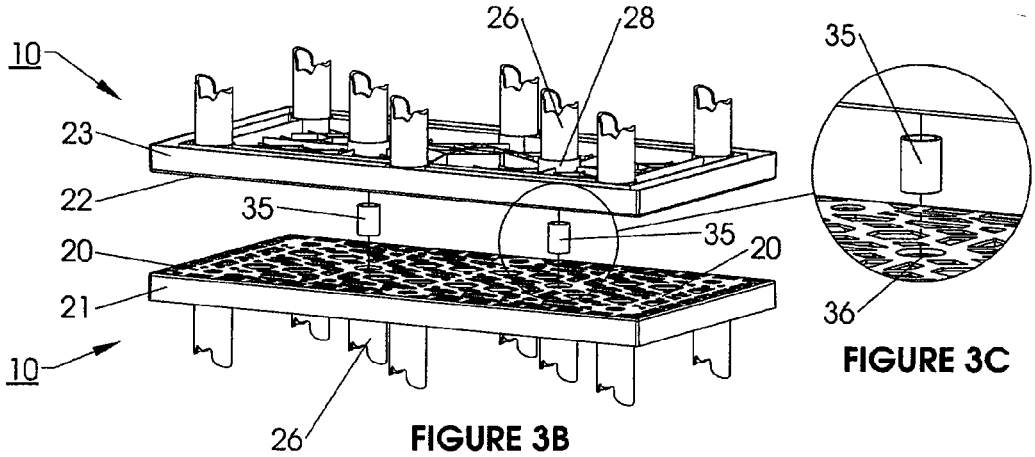
FIGURE 3C
FIGURE 3B

WATER DRAIN TANK OR CHANNEL MODULE

CROSS-REFERENCE TO RELATED APPLICATION

This application claims the benefit under 35 U.S.C. § 119 (e) of U.S. Provisional Application No. 60/771,417, filed Feb. 8, 2006, the entire disclosure of which is hereby incorporated herein by reference.

BACKGROUND OF THE INVENTION

The present invention relates to water drain tank modules or channel modules, as well as to assemblies of the modules, to temporarily hold or divert water, typically storm water, from erosion paths or areas susceptible to flooding, and to control water drainage at least out of the modules.

More particularly, the present invention relates to a module that is easy to manufacture and assemble into an assembly of modules to create a water drain tank or drainage channel for controlling the flow of water at least out of the modules, as well as assemblies made from such modules.

The present invention controls the runoff of water from natural runoff areas, as well as construction sites, and other locations, where such runoff otherwise may cause a problem with respect to overflow areas, silt build-up and the like. In addition, the modules, alone or together as an assembly, restrict the entry of sediment into the modules or assembly and control the retention of soil abutting them when they are installed in a trench or otherwise underground.

The water drain tank or channel modules of this invention may be manufactured readily, are portable and may be assembled on site. The modules comprise a novel supporting structure to provide versatility in assembling both the modules themselves and assemblies of modules to create effective drainage channels. The modules and assemblies form holding tanks or reservoirs or slow-release tanks, reservoirs or channels to allow controlled release of runoff or storm water.

BRIEF SUMMARY OF THE INVENTION

One aspect of the present invention relates to a water drain tank or channel module comprising a structure having a top platen and a bottom platen, a plurality of generally vertical support members for supporting at least the top platen, the support members being retained in sockets on at least one of the bottom platen and the top platen, and optional side walls each comprising a water-permeable lattice member that is adapted to support an impermeable membrane or water-permeable geotextile material that is capable of controlling the flow of drain water at least out of the module and restricting sediment from entering the module.

Another aspect of the present invention relates to an assembly of modules to create a water drain tank or channel, wherein each module comprises a structure having a top platen and a bottom platen, a plurality of generally vertical support members for supporting the top platen, the support members being retained in sockets on at least one of the bottom platen and the top platen, and side walls as are necessary to form outer peripheral side walls of the assembly, each module side wall comprising a water-permeable lattice member that is adapted to support an impermeable membrane or a water-permeable geotextile material capable of controlling the flow of drain water at least out of the assembly and restricting sediment from entering the assembly, to create a tank or drain channel, and wherein at least the outer peripheral walls of the assembly are at least partially covered with the geotextile material.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings:

FIG. 3A is a schematic isometric view of a portion of a module according to the present invention with some of the top platen, walls and other details removed for the sake of clarity, and without any covering of the module walls with a water-permeable geotextile material or a water-impermeable covering;

FIG. 3B is a schematic exploded isometric view of an assembly made using two vertically-stacked modules according to the present invention, where portions of the modules are removed for the sake of clarity;

FIG. 3C is an enlarged isometric view of the circled area of FIG. 3B, showing the use of one exemplary interlocking cylinder to align and interlock the vertically-stacked modules;

DETAILED DESCRIPTION OF THE INVENTION

Figure 1A:
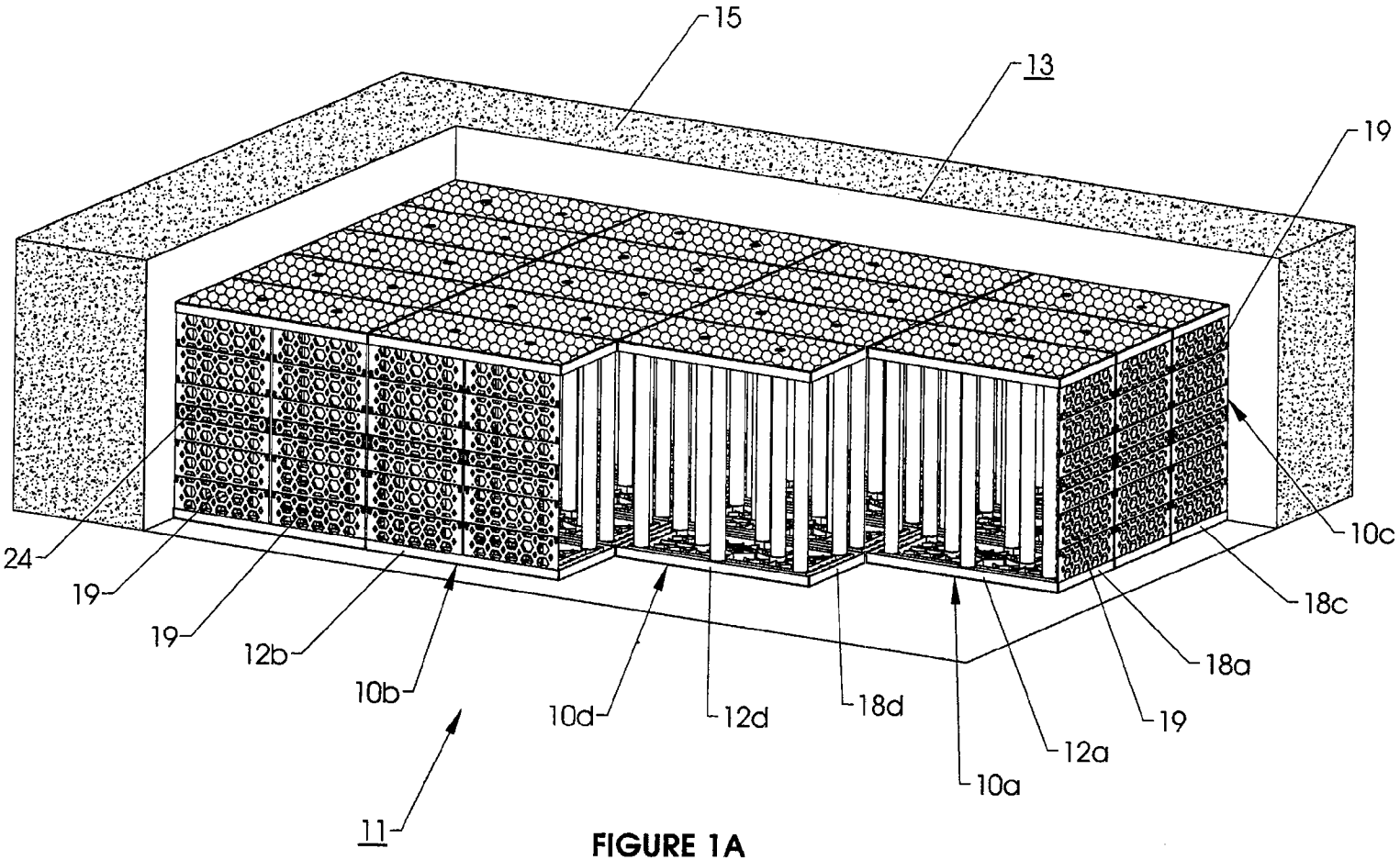
FIG. 1A is an isometric view of an assembly of modules according to the present invention forming a water drain tank or channel, with some modules removed for the sake of clarity, schematically showing the location of the assembly within a hole or trench in the ground.

Certain terminology is used in the following description for convenience only and is not limiting. The words "lower," "upper," "bottom," "top," "front," "back," "left," "right" and "sides" designate directions in the drawings to which reference is made, but are not limiting with respect to the orientation in which the modules or any assembly of them may be used. The terminology includes the words specifically mentioned above, derivatives thereof and words of similar import.

As used herein, the article "a" or a singular component includes the plural or more than one component, unless specifically and explicitly restricted to the singular or a single component.

As used herein, "sediment" means the sand, gravel, soil, dirt or other solid particles surrounding the module or assembly of modules, which the geotextile material used with the modules and assembly restrict from entering the modules or assembly.

Referring to the drawings, where like numerals indicate like elements throughout the several views, there is shown a module 10 either individually or when assembled together as an assembly 11 of modules 10, that is adapted to be buried in an appropriate location in the ground. The modules 10 of the present invention may be assembled side-to-side, front-to-back, top-to-bottom or in any other combination or alternative arrangement thereof. FIG. 1A shows a number of modules 10 formed into a module assembly 11 that is located within a hole or trench 13 in the ground 15. Details of the modules 10 are explained below, and details of exemplary assemblies 11, made from modules 10, 10' and 10" are explained below with reference to FIGS. 1A and 4. The hole or trench 13 has a bottom and walls of appropriate dimensions to hold the assembly 11. Typically, a module 10, or an assembly 11 is wrapped with appropriate geotextile material at least partially around the outer peripheral side walls, the top and the bottom of the module 10 or assembly 11 to control the flow of drain water at least out of the module or assembly and to restrict sediment from entering the assembly, thereby creating a drain tank or channel. Optionally, to create a holding or storage tank or reservoir, an impermeable membrane is wrapped at least partially around the outer peripheral side walls, the top and the bottom of the module 10 or assembly 11. Thereafter, sediment of the appropriate type is backfilled between the walls of the hole or trench 13 and the outer peripheral side walls and the top of the module 10 or assembly 11 to bury the module or assembly, which can thereby control water runoff and draining.

With reference to FIGS. 1B-3A, an embodiment of a module 10 is shown that includes four sides identified as a front 12, a rear 14, and first and second opposed sides 16 and 18, as well as a top platen 20 and a bottom platen 22. The sides may have optional walls made in a lattice structure or mesh structure (hereinafter referred to as a lattice member) 24, that may be formed using at least one panel 19. As shown, each of the front 12 and rear 14 has a wall of two panels 19, and each of the sides 16 and 18 has a wall of one panel 19. The panels 19 of the lattice members 24 are water permeable and have an open area of about 20% to about 80%, and in a preferred embodiment have an open area of about 50%. The top platen 20 and bottom platen 22 may have different structures or preferably, the same structure that in use is simply inverted to be the top or bottom platen. The top and bottom platens are also water permeable and have an open area of about 20% to about 80%, and in a preferred embodiment have an open area of about 45%. As noted above and explained in more detail below, the module 10 may be constructed without side walls to form a completely open structure without vertical walls or lattice members 24 or panels 19.

The lattice members 24 may be of any desired configuration or materials, such as, without limitation, a synthetic polymer or fiber-filled polymer, such as polypropylene, a combination of polypropylene and polyethylene, or alternatively, polyvinylchloride (PVC), among others, that may be formed into a lattice by injection molding or other molding method, extrusion or pultrusion, thermoforming or the like, wire mesh of the type used in chain-link fences, that may be galvanized steel or other suitable material, or other materials. The top and bottom platens 20 and 22, respectively, which preferably have the same structure, may also be of any desired configuration or materials, such as, without limitation, a synthetic polymer or fiber-filled polymer, such as polypropylene, a combination of polypropylene and polyethylene, or alternatively, polyvinylchloride (PVC), among others, that may be formed into a lattice by injection molding or other molding method, extrusion or pultrusion, thermoforming or the like, or metal, such as galvanized steel or other suitable metal, or other materials.

Figure 1B:
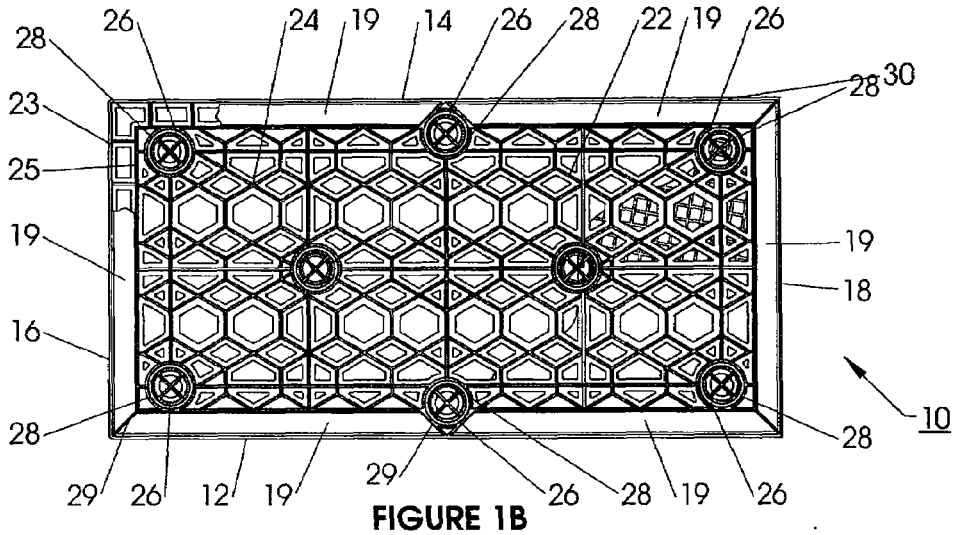
FIG. 1B is a top plan view of a module of the present invention with the top platen and a portion of lattice members in one corner removed to show the support structure of the bottom platen and a water-permeable geotextile material (only a portion of which is shown for the sake of clarity) below the bottom platen.

Preferably, the top and bottom platens have inner and outer peripheral edge flanges, forming channels to accommodate portions of the lattice member panels 19. For example as shown best in FIGS. 1B and 3A, the bottom platen 22 has an upwardly extending outer peripheral edge flange 23 and an upwardly extending inner peripheral flange 25 that define a channel 27 for retaining the lower edges of the panels 19. There is a similar channel (not shown) in the top platen 20 defined by a downwardly extending outer peripheral edge flange 21 and a downwardly extending inner peripheral flange (not shown) for retaining the upper edges of the panels 25. The flanges 21 and 23 thus overlap portions of the panels 19 located along the front 12, rear 14 and sides 16 and 18, to capture the panels 19 for enhanced structural integrity of the module. As best seen in FIG. 1B, the panels 19 preferably have beveled vertical edges 29 to abut smoothly with each other in corners and with the structure within the channels 27 of the top and bottom platens 20 and 22.

The top platen 20 is supported by an appropriate number, based on the size and shape of the modules, of support members 26, preferably in the form of tubes of any convenient cross-section, such as circular, and having any suitable dimensions, which in turn are supported by the bottom platen 22. It is presently preferred that each module be in a six-sided shape, with the module sides 12, 14, 16 and 18 and the top and bottom platens 20 and 22 each in a quadrilateral shape, including a rectangular or square shape, as shown in the drawings, with a number of edge support members 26 and some interior support members 26. For example, the embodiment as shown in FIGS. 1A, 1B, 3A, 3B and 4 has eight support members, one in each corner and one in the middle of the front and rear where the panels 19 for the front 12 and the rear 14 are rectangular, and two centered in the interior 29 of the module to equally support any load on the top platen, where the preferred spacing is best shown in FIG. 1B. If the top and bottom platen plan view dimensions are reduced, only four support members 26 might be used. Further, if the top and bottom platens are made hexagonal or triagonal it would be possible for a construction with only one support member per top and bottom platen. The support members 26 are preferably retained at their tops and bottoms by collars 28 on the top and bottom platens. The collars may be formed integrally and unitarily with the top platen 20 and the bottom platen 22, or the collars may be separately attached to the top platen 20 and the bottom platen 22 by suitable adhesives, fasteners such as screws, rivets or the like, or in any other suitable manner.

Figure 2:
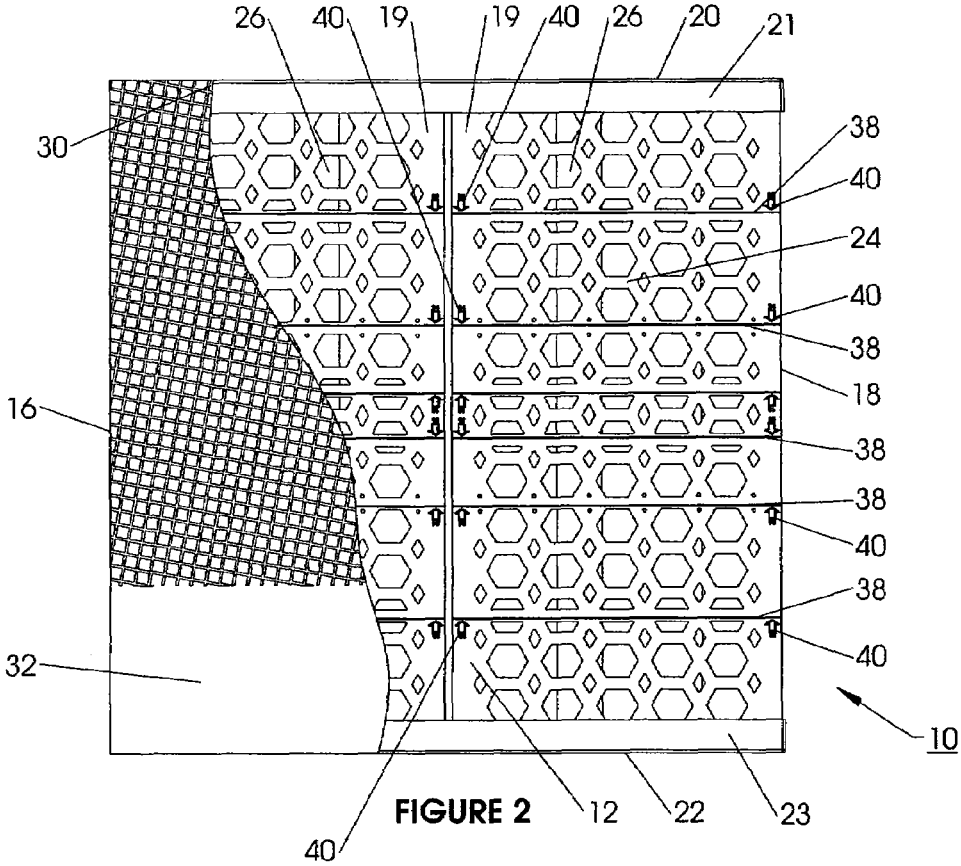
FIG. 2 is a front elevation view of the module of FIG. 1B, showing the covering of the front wall with a geotextile material and the optional use of a water-impermeable covering that would extend at least partially around the side walls and under the bottom platen, (only portions of both of which are shown for the sake of clarity), such that this module would function as a holding or storage tank or reservoir.

The support members 26 are preferably made from PVC pipe, for example without limitation, with a circular cross-section, and a standard outside diameter of about 2.375 inches (6 cm) and an inside diameter of about 2 inches (5.1 cm). This type of PVC pipe is readily available, is inexpensive, strong, durable and is easy to cut to form the desired module height which is preferably about 6 inches (15.2 cm) to about 36 inches (91.4 cm). As best seen in FIG. 2, the side panels 19 are optionally, but preferably, marked with a number of horizontal lines 38 and indicating arrows 40 that identify where to cut the panels 19 to pre-selected heights, such lines 38 and arrows 40 being compatible with the cutting of the support members 26 to 6 inch (15.2 cm) incremental module heights.

The module 10, as best seen schematically in FIG. 3A, forms a water-permeable module with a void space schematically shown as area 31, but extending everywhere between the walls and in the absence of walls into the adjacent module void spaces. It is important that the structures of the top and bottom platens 20 and 22, as supported by support members 26, have sufficient integrity and strength to resist vertical and lateral loading and to support other modules when stacked vertically together, for example as an assembly 11 shown schematically in an exploded view in FIG. 3B. When stacked vertically as shown in FIG. 3B, it is especially important to align the vertical support members 26 in the upper modules with the vertical support members 26 in the lower modules. The enlarged partial view of FIG. 3C shows a preferred arrangement for aligning and interlocking the upper and lower modules 10, by using interlocking cylinders 35 that extend through apertures or sockets 36 in the top platen 20 and the bottom platen 22.

Figure 3D:
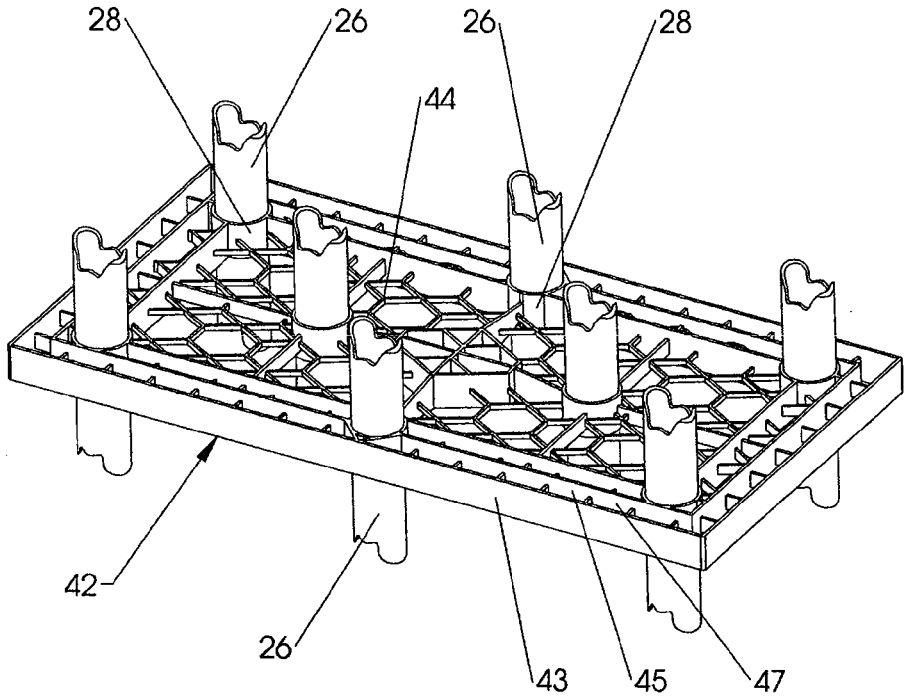
FIG. 3D is a schematic isometric view of a portion of another embodiment of an assembly of vertically stacked modules according to the present invention, in which an intermediate platen substitutes for the top and bottom platens as shown in FIG. 3C and functions as a common or combined top and bottom platen, such that the intermediate platen includes top and bottom sockets to retain the vertical support members and for interlocking vertically stacked modules.

FIG. 3D shows another embodiment of a platen for use in an assembly 11 of vertically stacked modules 10 according to the present invention, in which a single intermediate platen 42 substitutes for the top platen 20 and the bottom platen 22 as shown in FIG. 3C and functions as a common or combined top and bottom platen, such that the intermediate platen 42 includes top and bottom sockets 28 to retain the vertical support members 26 in alignment and for interlocking vertically stacked modules. The intermediate platen 42 has a horizontal support surface 44, and also preferably includes outer edge flanges 43 and inner flanges 45, both extending upwardly and downwardly from the horizontal support surface 44 to create channels 47 for the upper edges of any panels 19 used in the lower module and for the lower edges of any panels 19 used in the upper module.

It is also important that the support structure for lattice members 24, such as in the form of panels 19, be capable of supporting water-permeable and sediment restricting geotextile material 30, shown partially covering the bottom platen 22 in FIG. 1B, and partially covering the front 12 panels 19 in FIG. 2, both for the sake of clarity. Suitable water-permeable geotextile material 30 is typically made from polyester or polypropylene yarns, for example, as is well-known to those skilled in this art and is readily available. The geotextile material 30 withstands extended contact with sediment and water without degrading. Due to the water-permeable characteristics of the geotextile material, it allows water within the void space 31 of the module 19 or assembly 11 to flow out of the module 10 or assembly 11 and into the surrounding environment, typically including layers of gravel, sand or other more water-permeable material than densely-packed soil, such as clay, that may be in the strata surrounding the module 10 or module assembly 11. The geotextile material 30 allows runoff, storm or other water to flow slowly out of the module 10 or module assembly 11, and from the void space 31 of the module 10 or module assembly 11, while inhibiting the entry of sediment into the void space 31 of the module 10 or module assembly 11. The geotextile material 30 may cover one or more walls of each module 10. Alternatively, when the modules, such as 10, 10' and 10", are assembled together to form one embodiment of a module assembly 11 as shown in FIG. 4, the geotextile material 30 may cover some or all of the outside walls to create a water drainage tank or channel formed by the interconnected void spaces 31 of the modules 10, 10' and 10".

If desired to form a holding tank or reservoir from a module 10 or module assembly 11, for a water detention purpose, an optional water-impervious covering 32, best shown in FIG. 2, such as various types of synthetic polymeric plastic sheeting, could cover all or a portion, such as the bottom platen 22 and entirely, or as shown, partway up the panels 19 of the lattice members 24 at the front 12, rear 14, and sides 16 and 18. The top portion of the side panels could be covered with the geotextile 30 as shown. When a water-impervious covering is provided, the water is held within the module for storage and subsequent release by pumping or a restricted flow method.

Figure 4:
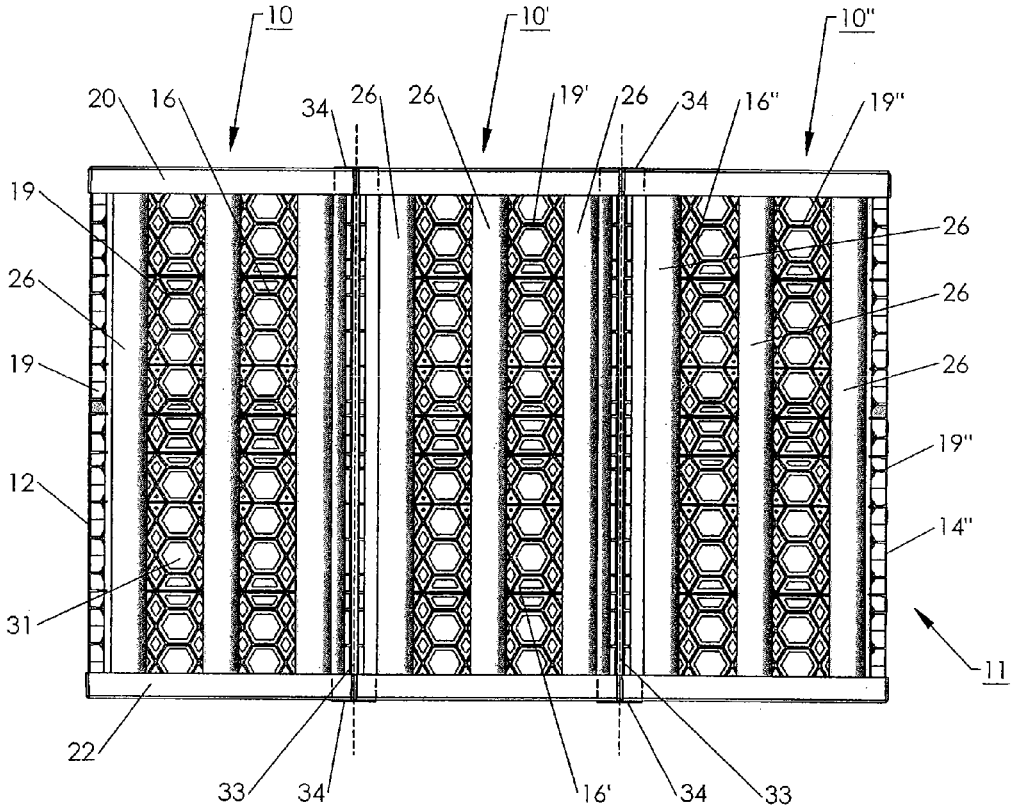
FIG. 4 is a schematic side elevation view of three modules assembled together front-to-back to form a modular drainage assembly, with the geotextile covering removed for the sake of clarity.

With reference to FIG. 4, an exemplary, non-limiting embodiment of a module assembly 11 is shown as formed from three modules 10, 10' and 10" arranged in a lateral front-to-back alignment. In the module assembly 11 of FIG. 4, the interior front and rear walls of the various modules have been eliminated to form a less restrictive flow path or channel for water to flow within the module assembly 11. The edges of side walls 16 are shown adjacent to each other at the dashed lines 33 in FIG. 4. While not necessary, the modules 10, 10' and 10" may be held together by clips, staples, wire ties or the like, as shown schematically by reference to fasteners 34 in FIG. 4. Thus, in this embodiment, the module 10 has a front 12 with two lattice panels 19 (to the left in FIG. 4), namely a forward panel 19 and a rearward panel (not visible); sides 16 and 18 with lattice panels 19 shown on side 16 (to the rear in FIG. 4), a top platen 20 and a bottom platen 22. Module 10' has only a top platen, a bottom platen and sides with panels 19' (only the panel 19' on side 16', to the rear in FIG. 4, is visible) walls; and module 10" has a top platen, a bottom platen and side walls with panels 19" (only the panel 19" on side 16", to the rear in FIG. 4, is visible), as well as a rear 14" with two panels 19", namely a forward panel 19" and a rearward panel (not visible). If the middle module 10' also had another module stacked on top of it, then the top platen of module 10' could be eliminated and the bottom wall of the module stacked on top of module 10' could also be eliminated, or alternatively these top and bottom platens could be replaced by an intermediate platen like intermediate platen 42 as shown in FIG. 3D.

Likewise, module 10' could only have a top platen 20 and bottom platen 22 if it served as a junction module internally within a module assembly such that all four sides of the module 10' were open.

As shown best in FIG. 1A, when two or more modules are formed laterally into a module assembly 11, there may be at least three types of modules 10, such as an outer module 10*a* with one side 18*a* having a panel 19; an outer module 10*b* with a front or rear, such as front 12*b* having at least one, and preferably two panels 19; a corner module 10*c* with one side 18*c* and a front or rear (neither visible in FIG. 1A) with one or preferably two panels 19; and one or more interior modules 10*d*, each having only a top platen and a bottom platen but no panels on its front, rear or sides.

Typically, but certainly not exclusively, in one preferred embodiment, the front and rear 12 and 14 of the module 10 are defined as sediment resistant by installation of two identical lattice panels 19, each panel having dimensions of about 36 inches (91.4 cm) high by about 18 inches (45.7 cm) wide and by laying over the lattice panels a geotextile fabric 30. In this preferred embodiment, each of the sides 16 and 18 uses only one of the same lattice panels 19 per side having the same dimensions as used for the front 12 and rear 14. Thus, typically, by way of example and without limitation, for this embodiment, the dimensions of the lattice panels are about 36 inches (91.4 cm) high by about 18 inches (45.7 cm) wide. In this preferred embodiment, each of the top platen 20 and the bottom platen 22 is formed with eight vertical support member sockets unitarily molded in to the platen, such that the typical, but non-limiting plan dimensions for the top and bottom platens of this embodiment would be about 36 inches (91.4 cm) long by about 18 inches (45.7 cm) wide. When fully assembled using a top and bottom platen and six lattice panels, as a single module tank, the dimensions of the preferred module are 36 inches (91.4 cm) from side to side, 36 inches (91.4 cm) in height and 18 inches (45.7 cm) from front to rear.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A water drain tank or channel module comprising a structure assembled from and having a top platen and a bottom platen, a plurality of generally vertical support members for supporting at least the top platen, the support members being separably retained in sockets on at least one of the bottom platen and the top platen, and from 0 to 3 side walls, each of the side walls, when present in the module, comprising a water-permeable lattice member, wherein at least one of the bottom platen, the top platen and the side walls is adapted to support an impermeable membrane or water-permeable geotextile material that is capable of controlling the flow of drain water at least out of the module and restricting sediment from entering the module, the module further comprising a void space between the top platen and the bottom platen, and extending everywhere between the walls, and in the absence of walls into any adjacent module void space, except for the support members, wherein no side walls are present when the module is used as an interior module in an assembly of the modules, wherein one side wall is present when the module is used as an outer module between corners of an assembly of the modules, wherein two opposed side walls are present when the module is used as a module between end modules in an assembly of the modules one module in width, wherein two adjacent side walls are present when the module is used as an outer corner module in an assembly of the modules, and wherein three adjacent side walls are present when the module is used as an end module in an assembly of the modules one module in width.

2. The module of claim 1, wherein the lattice members are wire mesh lattice members made of galvanized steel.

3. The module of claim 1, wherein the lattice members are synthetic or fiber-filled polymeric lattice members in the form of at least one lattice member panel installable separately from the other components of the structure.

4. A water drain tank or channel assembly comprising at least two modules according to claim 1.

5. The assembly of claim 4, comprising at least one interior module without any side walls and a plurality of outer modules, each outer module having at least one outer peripheral side wall of the assembly and at least two interior open sides without side walls.

6. The assembly of claim 4, comprising a module having two side walls and two interior open sides without side walls and two modules having three side walls and one interior open side without a side wall.

7. The assembly of claim 4, wherein the support members are tubular members.

8. The assembly of claim 4, wherein the lattice members are wire mesh lattice members made of galvanized steel.

9. The assembly of claim 4, wherein the lattice members are synthetic or fiber-filled polymeric lattice members in the form of at least one lattice member panel installable separately from the other components of the structure.

10. The assembly of claim 9, wherein the polymeric lattice members are injection molded.

11. The assembly of claim 4, wherein the shape of each module is six-sided, with each side having a quadrilateral shape.

12. The assembly of claim 4, wherein a front of one module abuts a rear of another module.

13. The assembly of claim 4, wherein a side of one module abuts a side of another module.

14. The assembly of claim 4, wherein a side of one module abuts one of a front and back of another module.

15. The assembly of claim 4, wherein the modules are stacked vertically.

16. The assembly of claim 15, further comprising interlocking cylinders extending through apertures or sockets in adjacent top and bottom platens to align and interlock the vertically stacked modules.

17. The assembly of claim 15, further comprising an intermediate platen which substitutes for both a top platen of a lower module and for a bottom platen for an upper module, and wherein the support members are retained in sockets on the intermediate platen.

18. The assembly of claim 4, wherein the assembly comprises a plurality of interior modules having interior abutting sides without side walls, wherein the interior abutting sides of adjacent interior modules abut each other or at least one abutting interior side of an outer peripheral module.

19. The assembly of claim 4, further comprising a geotextile material covering at least partially the side walls, the top platen and the bottom platen.

20. The assembly of claim 4, further comprising a water-impermeable membrane covering at least partially the side walls, the top platen and the bottom platen.

21. The assembly of claim 4, further comprising a geotextile material covering at least a portion of at least one lattice member on at least one outer peripheral side wall.

22. The assembly of claim 4, further comprising a water-impermeable membrane covering at least a portion of at least one outer peripheral side wall such that water is retained longer in the assembly than in the absence of the water-impermeable membrane.

* * * * *